United States Patent [19]

Miller

[11] Patent Number: 4,741,190

[45] Date of Patent: May 3, 1988

[54] LOCKSET ASSEMBLY

[75] Inventor: Theodore H. Miller, New Britain, Conn.

[73] Assignee: Emhart Industries, Inc., Farmington, Conn.

[21] Appl. No.: 915,294

[22] Filed: Oct. 3, 1986

[51] Int. Cl.[4] ..... E05B 55/00

[52] U.S. Cl. ..... 70/467; 70/469; 70/475; 70/478; 70/DIG. 42; 292/169.15; 292/358

[58] Field of Search ..... 70/469, 473, 475, 477, 70/478, DIG. 42, 467, 470, 471, DIG. 31; 292/336.3, DIG. 62, 358, 152, 169.13–169.19

[56] References Cited

U.S. PATENT DOCUMENTS

| | | | |
|---|---|---|---|
| 1,057,795 | 4/1913 | Arens | 70/469 X |
| 2,729,847 | 1/1956 | Foster | 292/152 X |
| 4,594,864 | 6/1986 | Hart | 70/476 X |

*Primary Examiner*—Lloyd A. Gall

*Attorney, Agent, or Firm*—Barry E. Deutsch

[57] ABSTRACT

A lockset for a door comprising a latchbolt assembly including a bolt movable between a fully extended deadbolt locked position, and a retracted position. A spindle extends through the latch assembly in a direction transverse of the direction of movement of the bolt. Rotation of the spindle results in the bolt moving between its positions. The lockset further includes an operating assembly comprising a hand operator having a lock therein, a first plate mounted for linear movement in a direction transverse of the axis of the spindle, an actuating member connected to the hand operator for moving the first plate, a second plate having linear movement transverse to the axis of the spindle and adapted to be moved by the first plate, and rotatable drive member attached to the spindle and adapted to be rotated by the second plate. The second plate is movable between bolt retracted, and fully extended positions. A detent member engages the second plate when the locking member is unlocked for preventing the second plate from moving between its bolt unlocked and bolt fully extended positions.

4 Claims, 4 Drawing Sheets

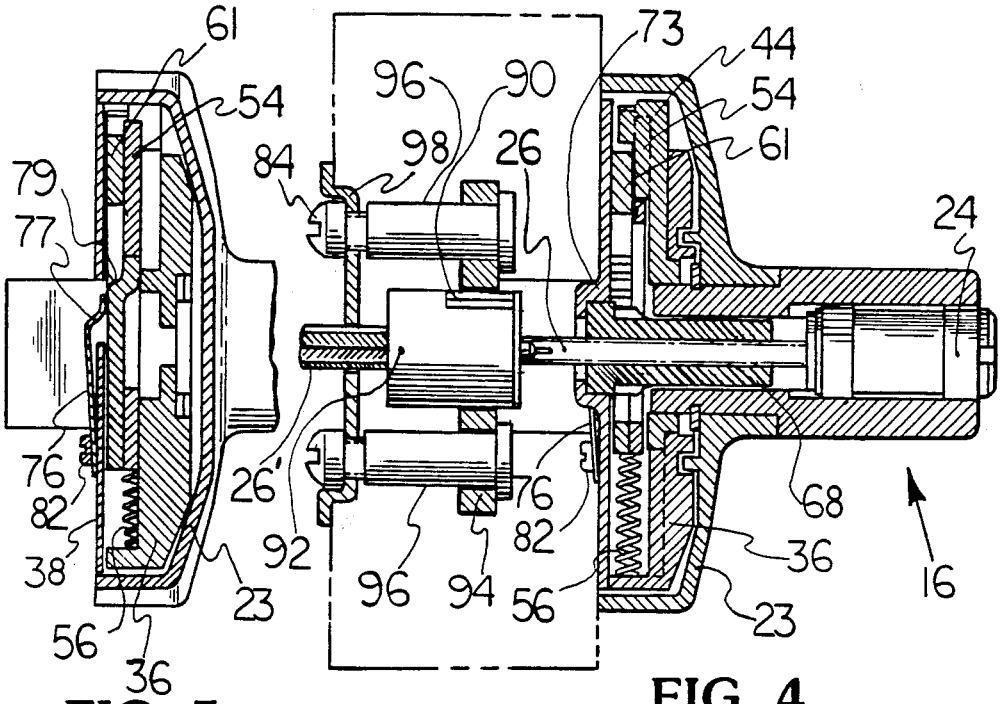
FIG. 5
FIG. 4
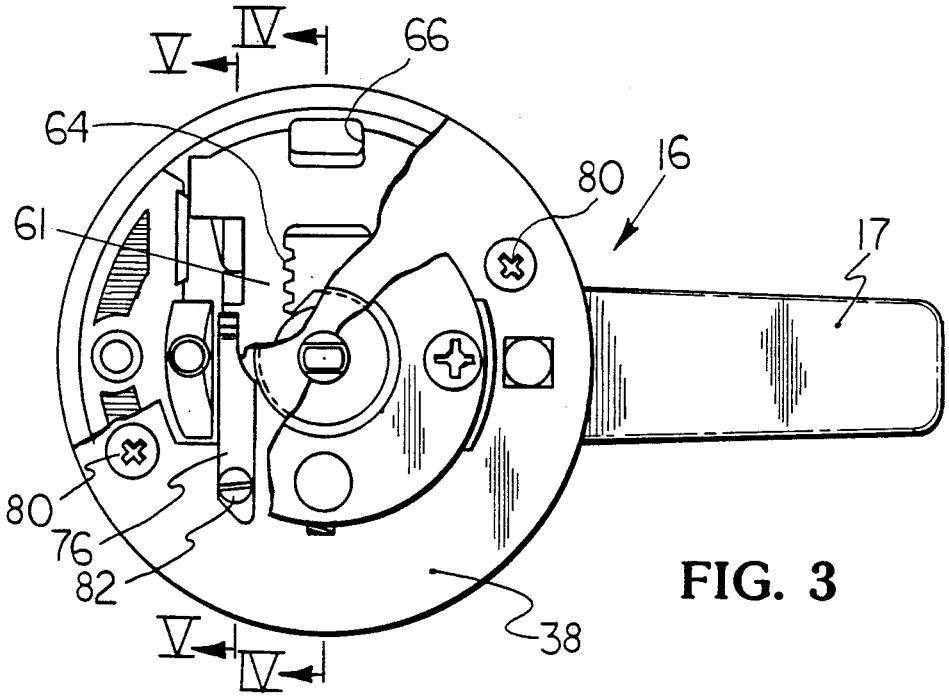
FIG. 3

LOCKSET ASSEMBLY

BACKGROUND OF THE INVENTION

This invention relates in general to a lockset assembly, having a latchbolt movable between an open position and a deadbolt extended locked position, and more particularly, to a lockset assembly in which the latchbolt is prevented from returning to its deadbolt locked position when a locking member of the assembly is placed in an unlocked state.

A recent innovation in lockset assemblies involves the utilization of a single bolt to function both as a latchbolt, and as a deadbolt. An example of this type of lockset is illustrated in U.S. Pat. No. 4,594,864 and co-pending application, Ser. No. 799,555, filed Nov. 19, 1985 and assigned to the same assignee as the assignee hereof. The lockset assembly disclosed in said patent and patent application includes both inside and outside hand operated members to retract the latchbolt. The lockset is primarily designed for use on a door controlling egress from and ingress into a building.

Typically, the outside hand operated member is maintained in a locked position. A key is used to place a locking member in an unlocked state to enable the outside member to be used to move the latchbolt into a retracted or open position. Once the key is withdrawn from the lock cylinder, the latchbolt is preferably automatically returned to its deadbolt locked position. As the latchbolt is automatically placed into its deadbolt locked position when the key is removed from the locking mechanism, a lockset assembly including said latchbolt is not totally suitable for use in applications where it is desired to periodically prevent the latchbolt from automatically returning to its deadbolt locked position from an unlocked position. Examples of such applications are locksets used on the exterior of doors of school rooms, storage rooms, emergency exits, or the like.

For example, a school room door should be capable of being locked during non-school hours so that unauthorized access into the school room is prevented. On the other hand, when the school room is normally occupied, it is desirable to prevent the latchbolt from automatically returning into a deadbolt locked position from an unlocked state when a key operating the locking member is withdrawn therefrom. Essentially, during the occupied hours, the latchbolt is maintained in an unlocked state when the door is closed.

It should be understood that, regardless of the state of the latchbolt, i.e., either locked or unlocked, the inside operator must be capable of enabling a person located on the inside of the door to move the latchbolt into an unlocked or open position without the necessity of using a key or similar device. Movement of the latchbolt under control of the inside operator may be accomplished via a lever or by use of a push-bar exit device such as shown in U.S. Pat. No. 3,877,262 issued Apr. 15, 1975, Merton Williams, inventor.

Accordingly, it is an object of the invention to provide a lockset assembly wherein the latchbolt is normally in a deadbolt locked position and wherein the latchbolt is prevented from automatically returning to its deadbolt locked position when a locking member of the lockset is placed in an unlocked state.

SUMMARY OF THE INVENTION

The foregoing object and other objects of the invention are attained in a lockset for a door comprising a latchbolt assembly including a bolt movable between a fully extended deadbolt locked position, and a retracted position. A spindle extends through the latch assembly in a direction transverse of the direction of movement of the bolt. Means connect the spindle to the bolt for moving the bolt between its positions upon rotation of said spindle. The lockset further includes an operating assembly comprising a hand operator having locking means therein, a first plate mounted for linear movement in a direction transverse to the axis of said spindle, an actuating member connected to the hand operator for moving the first plate, a second plate having linear movement transverse to the axis of said spindle and adapted to be moved by the first plate, and rotatable drive means attached to the spindle and adapted to be rotated by the second plate, said second plate being movable between a bolt fully extended and locked position and a bolt unlocked position; and detent means for engaging the second plate when the locking means is unlocked for preventing the second plate from moving from a bolt unlocked position into a bolt fully extended and locked position.

BRIEF DESCRIPTION OF THE DRAWING

FIG. 3 is an elevation view, taken along line III—III of FIG. 1, with portions partially broken away for the purpose of clarity;

FIG. 4 is a sectional view taken along line IV—IV of FIG. 3;

FIG. 5 is a sectional view taken along line V—V of FIG. 3, illustrating the invention in a first operating position.

DESCRIPTION OF THE PREFERRED EMBODIMENT

Figure 1:
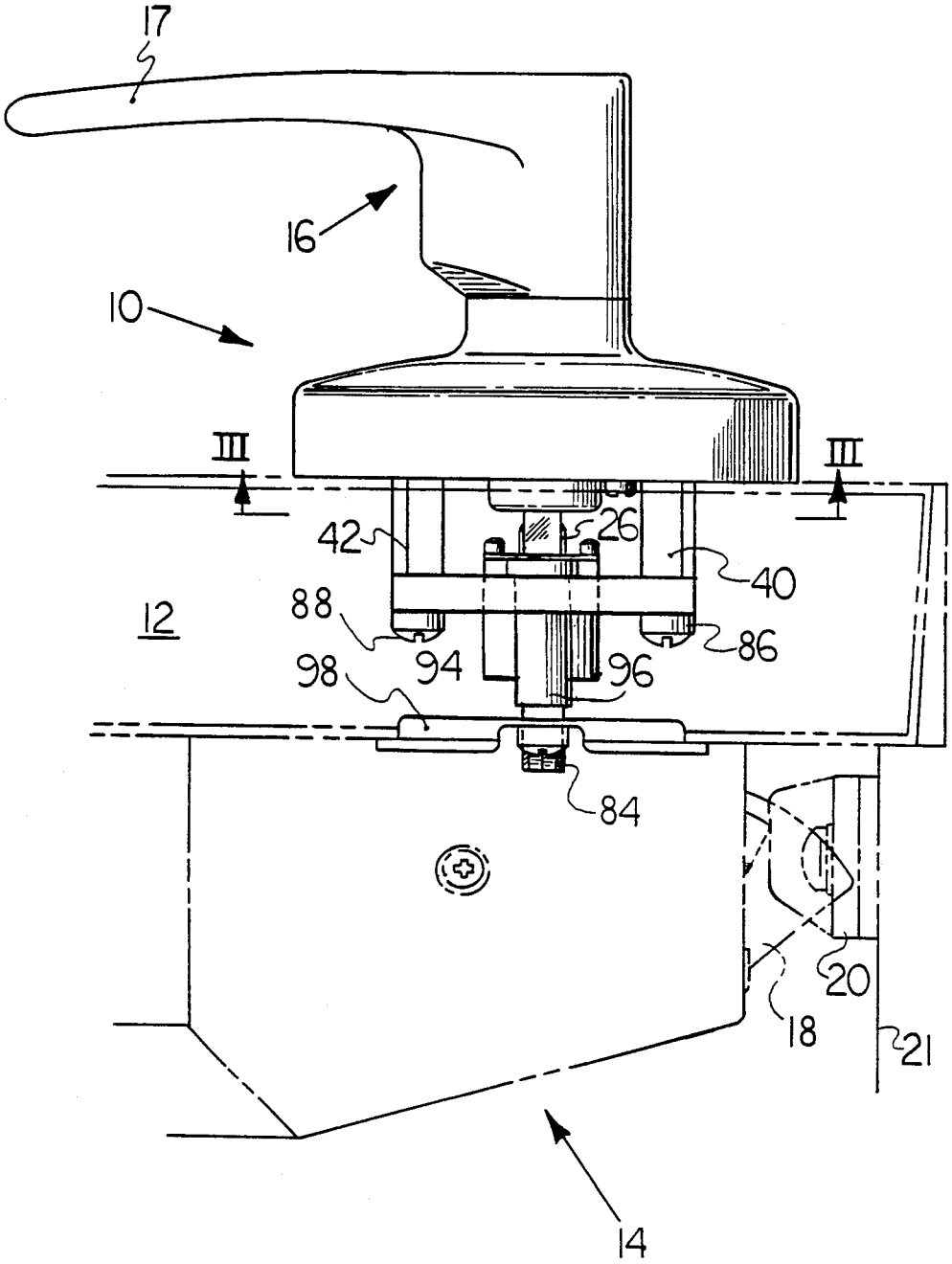
FIG. 1 is a plan view looking down upon a lockset assembly showing it mounted within a door.
Figure 2:
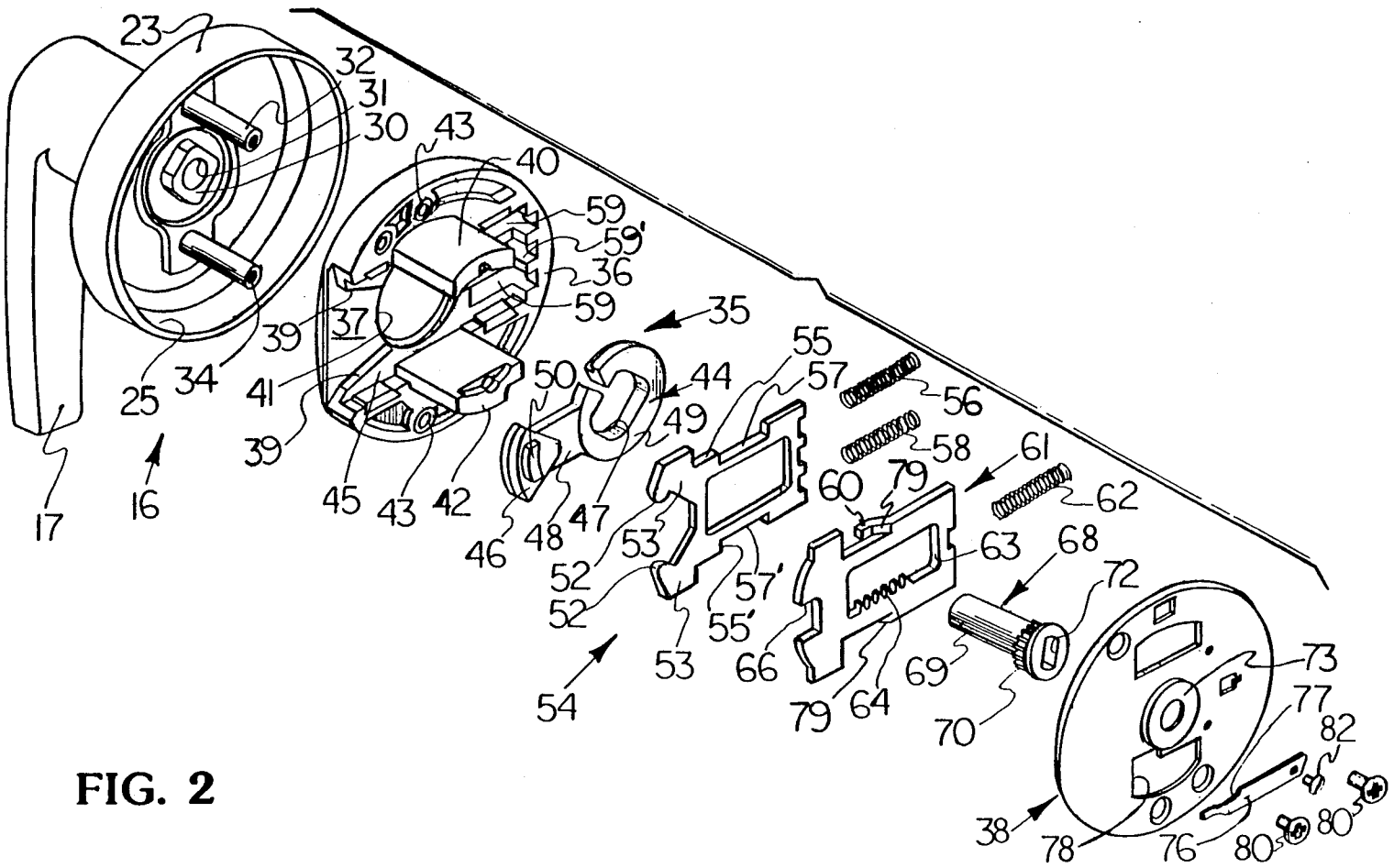
FIG. 2 is an exploded perspective view of a portion of the lockset assembly illustrated in FIG. 1.
Figure 6:
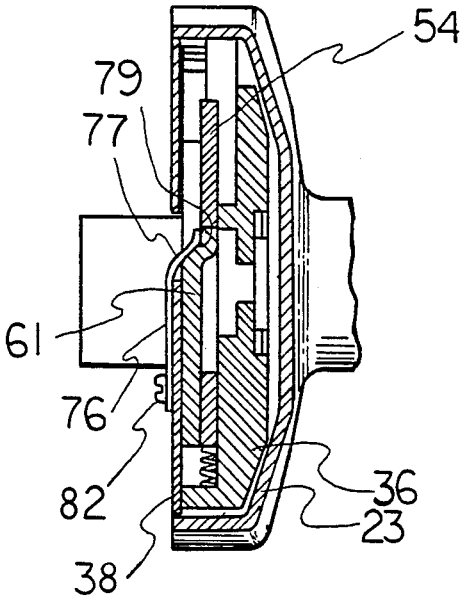
FIG. 6 is a view similar to FIG. 5 illustrating the invention in a second operating position.

Referring now to the drawing, there is disclosed a preferred embodiment of the present invention. In referring to the various figures of the drawing, like numerals shall refer to like parts.

Referring particularly to FIG. 1, lockset assembly 10 including the present invention is shown mounted in a door 12 and includes an outside hand operating member 16 and an inside hand operating member 14. Member 16 in the preferred embodiment is illustrated as a lever and member 14 in the preferred embodiment is illustrated as a push-bar exit device such as the one disclosed in U.S. Pat. No. 3,877,262 issued Apr. 15, 1975 in the name of Merton Williams. Members 14 and 16 are used to retract a latchbolt 18 of lockset mechanism 10 from a strike 20 mounted on doorjamb 21 in conventional fashion.

Referring now to FIGS. 2–6, the specific details of the present invention shall be described. Outside hand operator or operating member 16 includes a cassette 35 having a housing member 36. Housing member 36 includes a pair of vertically spaced apertures 43 which are positioned to receive pins 32 and 34 extending axially within bore 25 of housing 23 of lever 17. Housing member 36 is thus mounted within bore 25.

Housing member 36 further includes a centrally disposed aperture 41 into which square shape projection 30 of lever 17 extends. Projection 30 is disposed within bore 25 of housing 23. Housing 36 further includes a V-shaped opening or guide-way 37 defined by opposed surfaces 39 of vertically spaced walls 45. Operating member 16 further includes an actuating member 44 mounted for rotational movement within V-shaped guide way 37. Member 44 includes a base portion 49 defining a square shaped opening 47 adapted to receive generally square shaped projection 30 of outside lever 17. Actuating member 44 further includes a reduced elongated portion 48 terminating in a V-shaped raised cam surface 46 having a lug portion 50 extending outwardly therefrom.

Spring plate 54 is also positioned within housing 36 in overlapping relationship with actuating member 44. Spring plate 54 includes a pair of spaced fingers 53, each having a cam follower surface 52 thereon adapted to be engaged by V-shaped cam surface 46 of actuator member 44. Spring plate 54 is biased forwardly in the direction of extension of latchbolt 18 (to the left as viewed in FIG. 2) by means of two lever springs 56 and 58 positioned in a suitable groove 59 provided in housing 36. In the biased position, cam follower surfaces 52 are in engagement with cam surface 46 on actuating member 44. Spring plate 54 further includes cut out portions 57 and 57′ in both its upper and lower side edges which form tab engaging surfaces 55 and 55′.

Operating member 16 further includes a generally flat rack plate 61 within housing 36 in overlapping relationship with spring plate 54. The upper and lower edges of rack plate 61 have outward extending tab portions 60 extending into cut out portions 57 and 57′ in spring plate 54 in a position to be engaged by tab engaging surfaces 55 and 55′. Plate 61 has a generally rectangular internal cut out 63. Gearteeth 64 are provided on rack plate 61 adjacent one of the longer sides of cut out 63. The gearteeth form a rack which extends parallel to the axis of latchbolt assembly 18. The forward end of rack plate 61 is provided with a notch 66, into which extends lug portion 50 when the rack member is in its forward position, biased to the left as viewed in FIG. 2 by spring 62, to prevent rotation of actuating member 44. Spring 62 is positioned in groove 59′ of housing 36. When the lug portion 50 extends within notch 66, operator 16 cannot be rotated, which maintains latchbolt 18 in an extended locked position in the absence of an opening force being applied to inside operator 14.

Pinion member 68 extends perpendicular to the axis of latchbolt 18. Member 68 includes a set of gearteeth 70 which are in mating engagement with gearteeth 64 on rack plate 61. Pinion member 68 also includes a tubular extension portion 69 which extends through spring plate 54, actuating member 44, and housing 36, into an opening 31 in lever 17. As illustrated in FIG. 4, the head of pinion member 68 is contained within the inside of a boss 73 extending inwardly on cover member 38. Pinion member 68 includes a generally rectangular slot 72 for receiving spindle 26 which extends through the pinion member and is connected at one end to lock cylinder 24 in outside lever 17 to rotate pinion member 68 in response to rotation of the lock cylinder. Screws 80 or similar means are used to join cover member 38 to housing 36 to form the completed cassette subassembly.

The other end of spindle 26 terminates in a connector 92 having a lost motion member 90. Spindle 26′ extends from connector 92 into engagement with the operating mechanism for the push-bar exit device 14.

As the outside operator or lever is illustrated as being connected to a push-bar exit device 14 mounted on the inside of the door, a special mounting assembly is employed to join the outside lever to the inside exit device. Such mounting assembly includes a generally circular plate 94 which, as illustrated in FIG. 1, is connected to projections 40 and 42 via cap screws or similar means 86 and 88. Plate 94 in turn mounts a pair of vertically spaced axially extending stubs 96. Stubs 96 are used to mate with cap screws 84 or similar means which are used to secure retaining plate 98 to the inside surface of the door. Retaining plate 98 acts as a transition member for connecting spindle 26′ to the operating mechanism of push-bar exit device 14.

The outside hand operating member 16 just described is conventional within the art. If more details thereof are required, reference may be had to co-pending U.S. application Ser. No. 799,555 filed Nov. 19, 1985 and issued U.S. Pat. No. 4,594,864. Typically the outside member 16 is used in application when a latchbolt is automatically returned to an extended and locked position when the door is closed. A key may be inserted within lock cylinder 24 to move the latchbolt to an unlocked position; however, when the key is removed, the latchbolt is automatically returned to its extended and locked position when the door is closed. The push-bar exit device or other inside operating member can be actuated to move latchbolt 18 from its extended and locked position to an open position and as illustrated in FIGS. 1 and 4, member 16 can be used to actuate spindles 26 and 26′, to move latchbolt 18.

In certain applications, it may be desirable to override the automatic return of the latchbolt to an extended and locked position so that, even though a key is removed from lock cylinder 24, the latchbolt will only be placed in its extended and unlocked position when the door is closed. The foregoing is accomplished via novel means of the present invention.

The novel means includes a detent mechanism which prevents the rack plate from moving to its forwardmost position in response to the biasing force exerted by spring 62. As noted previously, when rack plate 61 is in its forwardmost position, opening 66 thereof engages lug 50 of actuating member 44 to prevent the actuating member from rotating, thereby preventing lever 17 from likewise rotating, which in turn, prevents any rotational movement of spindles 26 and 26′. The detent mechanism operates to prevent rack plate 61 from automatically moving into its forwardmost or locked position merely upon closure of the door. The detent mechanism must be physically overridden by manually rotating lock 24 to its locked position to place rack plate 61 in its locked or forwardmost position.

In the preferred embodiment, the detent mechanism includes a spring 76 mounted on cover plate 38 by means of a screw or similar member 82. Spring 76 includes an axially inwardly facing shoulder 77 which extends through opening 78 in cover 38 as particularly shown in FIGS. 5 and 6. Shoulder 77 is aligned with shoulder 79 of rack plate 61. Thus, shoulder 77 of the spring extends into the path of movement of the rack plate. Spring 76 provides a force in opposition to the force developed by spring 62 to automatically return the rack plate to its locked position upon closure of the door. The opposing spring force exceeds the return spring force, resulting in spring 76 functioning as a detent to maintain the rack plate in an unlocked state.

As indicated previously, the present invention is intended to maintain a latchbolt of a locking device in an extended open state even though the locking device includes means for automatically returning the latchbolt to a locked extended position. Examples of uses of such a lockset include doors controlling access to a school room, a storage facility, or an emergency exit from a room wherein the outside lock of the emergency exit is normally closed. In each of the aforementioned applications, it is sometime desirable that the outside lock be placed in an open state whereby a person desiring access to the room does not have to employ a key to open the lock.

In the present invention, and assuming the lockset is initially in a locked state as illustrated in FIG. 5, a person desiring to attain access to the room and to permit others to have ready access thereto in response to rotation of operator 16 places a key into lock 24 and rotates same so that latchbolt 18 is placed in an unlocked state to enable the door to be opened. The key rotates lock 24, which in turn rotates spindle 26, causing pinion 68 to move rack plate 61 to the right to disengage lug 50 from notch 66. Rotation of spindle 26' in response to unlocking movement of lock 24 also results in rotation of lost motion mechanism 90 of connector 92. Mechanism 90 prevents the limited rotational movement of spindle 26 from being transferred to spindle 26'; thus the mere unlocking of lock 24 does not result in any movement of spindle 26'. However, with lug 50 disengaged from notch 66, operator 16 may be rotated. Rotation of operator 16 results in rotational movement of spindle 26, connector 92 and spindle 26' to retract latchbolt 18.

Once the latchbolt is unlocked, the person removes the key from lock 24. Spring 76 will have assumed the position illustrated in FIG. 6 whereby shoulder 77 confronts shoulder 79 of rack plate 61. Spring 76 provides a force to prevent return movement of the rack plate to its locked position through the inter-engagement of the corresponding shoulders.

So long as lock 24 remains in an open state, the mere opening and closing of the door will not result in the return of the plate to its extended locked position. The spring force generated by spring 76 is greater than the force generated by the means for automatically returning the plate to its locked position.

When the person wishes to relock operator 16, he inserts a key into lock 24 and then rotates spindle 26 to thereby move plate 61 forwardly whereby lug 50 again extends into notch 66. In effect, the person physically overrides the force generated by inter-engagement of shoulders 79 and 77 to physically place the latchbolt into a locked state.

While a preferred embodiment of the present invention has been described and illustrated, the invention should not be limited thereto but may be otherwise embodied within the scope of the following claims.

What is claimed is:

1. A lockset for a door comprised of a latch assembly including a bolt movable between a fully extended locked position, and a retracted position, a first spindle extending through said latch assembly in a direction transverse of the direction of movement of said bolt, means connecting said first spindle to said bolt for moving said bolt between its positions upon rotation of said first spindle, said connecting means including a second spindle and a lost motion mechanism joining said first spindle to said second spindle to permit rotational movement of said first spindle relative to said second spindle, and an operating assembly comprising a hand operator having locking means therein connected to said first spindle and movable between unlocked and locked positions such that movement of said locking means from its locked to unlocked position results in rotation of said first spindle through said lost motion mechanism relative to said second spindle, a first plate mounted for linear movement in a direction transverse to the axis of said first spindle, an actuating member connected to said hand operator for moving said first plate, a second plate mounted for linear movement in a direction transverse to the axis of said first spindle, and rotatable drive means attached to said first spindle and operable to drive said second plate between a fully extended position and a retracted position, spring means biasing said second plate from its retracted unlocked position towards its fully extended position, and detent means for engaging said second plate when the locking means is in an unlocked position for preventing the second plate from moving from a retracted position into a fully extended position.

2. A lockset in accordance with claim 1 wherein said detent means is a spring and said second plate includes means defining a shoulder engaged by said spring when said second plate is in said retracted position.

3. A lockset in accordance with claim 2 wherein said first plate, said actuating member, and said second plate are mounted in axial juxtaposition relative to said first spindle, said lockset further including a housing member and cover member axially spaced about said first spindle and sandwiching therebetween said first and second plates and said actuating member to form a subassembly, said detent spring being mounted on said cover, with said cover including means defining a slot opening towards said second plate, with a portion of said spring extending through said slot into the path of movement of said second plate to engage said shoulder.

4. A lockset in accordance with claim 1 wherein said first plate, said actuating member and said second plate are mounted in axial juxtaposition relative to said first spindle, said lockset further including a housing member and a cover member axially spaced about said first spindle and sandwiching therebetween said first and second plates and said actuating member to form a subassembly, said detent means being mounted on said cover, with said cover including means defining a slot opening toward said second plate, with a portion of said detent means extending through said slot into the path of movement of said second plate.

* * * * *